United States Patent [19]

Taguchi

[11] Patent Number: 4,815,135

[45] Date of Patent: Mar. 21, 1989

[54] SPEECH SIGNAL PROCESSOR

[75] Inventor: Tetsu Taguchi, Tokyo, Japan

[73] Assignee: NEC Corporation, Tokyo, Japan

[21] Appl. No.: 753,138

[22] Filed: Jul. 9, 1985

[30] Foreign Application Priority Data

| | | | |
|---|---|---|---|
| Jul. 10, 1984 | [JP] | Japan | 59-143045 |
| Jul. 31, 1984 | [JP] | Japan | 59-160491 |
| Jul. 31, 1984 | [JP] | Japan | 59-160492 |
| Aug. 6, 1984 | [JP] | Japan | 59-164455 |

[51] Int. Cl.[4] ..... G10L 5/00

[52] U.S. Cl. ..... 381/37

[58] Field of Search ..... 381/29-53

[56] References Cited

U.S. PATENT DOCUMENTS

| | | | |
|---|---|---|---|
| 3,102,165 | 8/1963 | Clapper | 381/51 |
| 3,102,928 | 9/1963 | Schroeder | 381/51 |
| 3,109,070 | 10/1963 | David | 381/51 |
| 3,431,362 | 3/1969 | Miller | 381/37 |
| 3,982,070 | 9/1976 | Flanagan | 381/51 |
| 3,995,115 | 11/1976 | Kelley | 381/36 |

*Primary Examiner*—Emanuel S. Kemeny

*Attorney, Agent, or Firm*—Foley & Lardner, Schwartz, Jeffery, Schwaab, Mack, Blumenthal & Evans

[57] ABSTRACT

Speech analysis and synthesis invole analysis for sinusoidal components and pitch frequency, and synthesis by first phase-resetting to zero at pitch period all sine oscillater components, whether periodic for voiced speech, or at random period in accordance with a random code for unvoiced speech. As a result, the synthesized speech signal has the initial line spectrum spread due to pitch structure for better speech quality. Frequency modulation may also be used.

22 Claims, 11 Drawing Sheets

| PARAMETER | | max $\{m_i\}$ $(i=1,2,---5)$ | | | | |
|---|---|---|---|---|---|---|
| | | $m_1$ | $m_2$ | $m_3$ | $m_4$ | $m_5$ |
| MAX-$m_i$ SPECIFY | | 1 bit | 3 bits | 3 bits | 3 bits | 3 bits |
| CSM AMPLITUDE | $m_1$ | 0 bit | 3 bits | 3 bits | 4 bits | 4 bits |
| | $m_2$ | 4 | 0 | 3 | 3 | 3 |
| | $m_3$ | 4 | 3 | 0 | 3 | 3 |
| | $m_4$ | 4 | 4 | 4 | 0 | 3 |
| | $m_5$ | 3 | 3 | 3 | 3 | 0 |
| TOTAL BITS | | 16 bits | 16 bits | 16 bits | 16 bits | 16 bits |

$\omega_i' = \omega_i + \theta_i$
$m_i' = m_i \cdot b_i$ $\theta_i = 0.5$ KHz
$b_1 = 0.5,\ b_2 = 0.6$
$b_3 = 1.0,\ b_4 = 1.2,\ b_5 = 1.5$ $\omega_i' = b \cdot \omega_i + \theta$
$b = 0.5$
$\theta = 1$KHz

SPEECH SIGNAL PROCESSOR

BACKGROUND OF THE INVENTION

This invention relates to a speech signal processor.

Attention has been drawn to techniques for extracting feature parameters such as spectral information and excitation source information from the speech signal to transmit them with reduced transmission bit rate. Of these techniques, the linear predictive coding (LPC) technique is extensively used because of its simple processing. The LPC technique involves extracting linear predictive coefficients as spectral information and predictive residual as excitation source information from the speech signal on the transmission side, and on the receiver side, determining weight coefficient with spectral information and exciting a synthesizing filter by the excitation source information to synthesize reproduced speech. The speech synthesizer for such an LPC technique is usually provided with a synthesizing filter including a feedback loop. This makes the circuit construction complex and reduces the stability of the synthesizing filter due to transmission error and other causes.

Under the circumstances, Sagayama et al., proposed a structurally very simple synthesizer needing to filter. Reference is made, for example, to "Composite Sinusoid Modeling Applied to Spectrum Analysis of Speech" Data S79-06 (May, 1979) and "Speech Synthesis by Composite Sinusoidal Wave" Data S79-39 (Oct., 1979) Laboratory of Speech. The Acoustical Society of Japan. This technique is termed CSM (acronym for Composite Sinusoid Model).

The CSM represents the speech signal as the summation or combination of a set of sinusoidal waves each having amplitude and frequency as parameters freely selectable. The number of these sinusoidal waves suitable for use is predetermined to be at the largest 4–6. For CSM analysis, frequency and amplitude (CSM parameters) of each sinusoidal wave are determined every analysis frame so that the lowest N order autocorrelation coefficients directly calculated from the speech signal is equal to the lowest N order autocorrelation coefficients of the corresponding synthesized wave.

Simple summation (combination) of the CSM signals of every frequency cannot reproduced the corresponding original speech. For reproducing original speech, it is necessary to attach pitch structure and impart a pich synchronous envelope to the summed CMS signal. The term "attachment of the pitch structure" means that the phase of sinusoidal wave is initialized to "0" every pitch period for voiced speech. This is done to make the line spectrum structure spread approach the natural speech spectrum. Also for unvoiced speech, line spectrum structure is spread by random phase initialization. The signal imparted with pitch structure as mentioned above is useful to obtain synthesized sound like speech. Initialization of sinusoidal wave phase to zero is accompanied by discrete jumps in the waveform. To smoothen out such jumps, the synthesized speech signal is multiplied an envelope synchronous with the pitch of the speech signal, such an envelope attenuation curve according to an exponential function.

Additionally, it is problematic whether the interval for phase initialization mentioned above is too narrow or wide. Too narrow initialization interval causes whitening, and in turn no occurrence of a spectrum envelope, while too wide initialization interval is associated with an insufficient frequency spread to obtain an appropriate spectral envelope. There has been problems in the conventional CSM technique also in that because of the application of random phase initialization for production of unvoiced sound, initialization is inevitably performed both at too narrow and too wide intervals with a resulting failure in obtaining good unvoiced speech.

In the conventional CSM technique, CSM parameters yielded by the analysis such as frequency and amplitude representing characteristics of the individual sinusoidal waves are quantized separately, leaving relationship between parameters out of consideration. This reflects in inadequate quantization to utilize characteristics of CSM parameters, and produces problems in quantization efficiency.

At present digital privacy telephone system are widely used in which generally the analog speech signal is converted into digital codes, followed by a specified coding, to maintain information of the original speech secret before transmission, and the received signals are decoded just inversely to the coding, followed by D/A conversion to reproduce the corresponding original speech signal. Such a digital communication system has the disadvantage of requiring high performance of the transmission line, such as transmission capacity and error rate.

There is also, for example, an analog privacy telephone system of subjecting the speech signal to spectral inversion or to spectral division and interchange of relative positions before transmission. It generally requires low transmission rates but the spectrum envelope of the original speech signal remains in some form, which contributes to defeat the privacy of the system.

SUMMARY OF THE INVENTION

Accordingly, it is an object of the invention to provide a CSM synthesizer for reproducing better quality unvoiced speech.

Another object of the invention is to provide a CSM speech processor with remarkably improved quantization efficiency.

A further object of the invention is to provide an analog telephone set with a high privacy.

A further object of the invention is to provide an analog telephone set with an improved privacy.

A further object of the invention is to provide a CSM synthesizer having simplified structure and reproducing better quality unvoiced speech.

A further object of the invention is to provide a speech processor having simplified structure without a filter and performing analysis and synthesis of speech.

A further object of the invention is to provide a speech processor with a high stability.

According to one aspect of the invention there is provided a speech signal processor comprising, an extractor from a speech signal for extracting amplitudes and frequencies of a set of sinusoidal wave signals representative of said speech, a sinusoidal wave generator for generating a set of sinusoidal wave signals having the extracted amplitudes and frequencies, combination means for combining the set of sinusoidal wave signals from the sinusoidal wave generator, a random code generator for generating random code signals having a distribution defined by predetermined finite upper and lower values, and a phase resetter for phase-resetting the sinusoidal wave signals in response to the pitch of the speech signal when the speech signal is voiced and at a period determined in accordance with a random code signal when the speech signal is unvoiced.

DETAILED DESCRIPTION OF THE PREFERRED EMBODIMENTS

Figure 1:
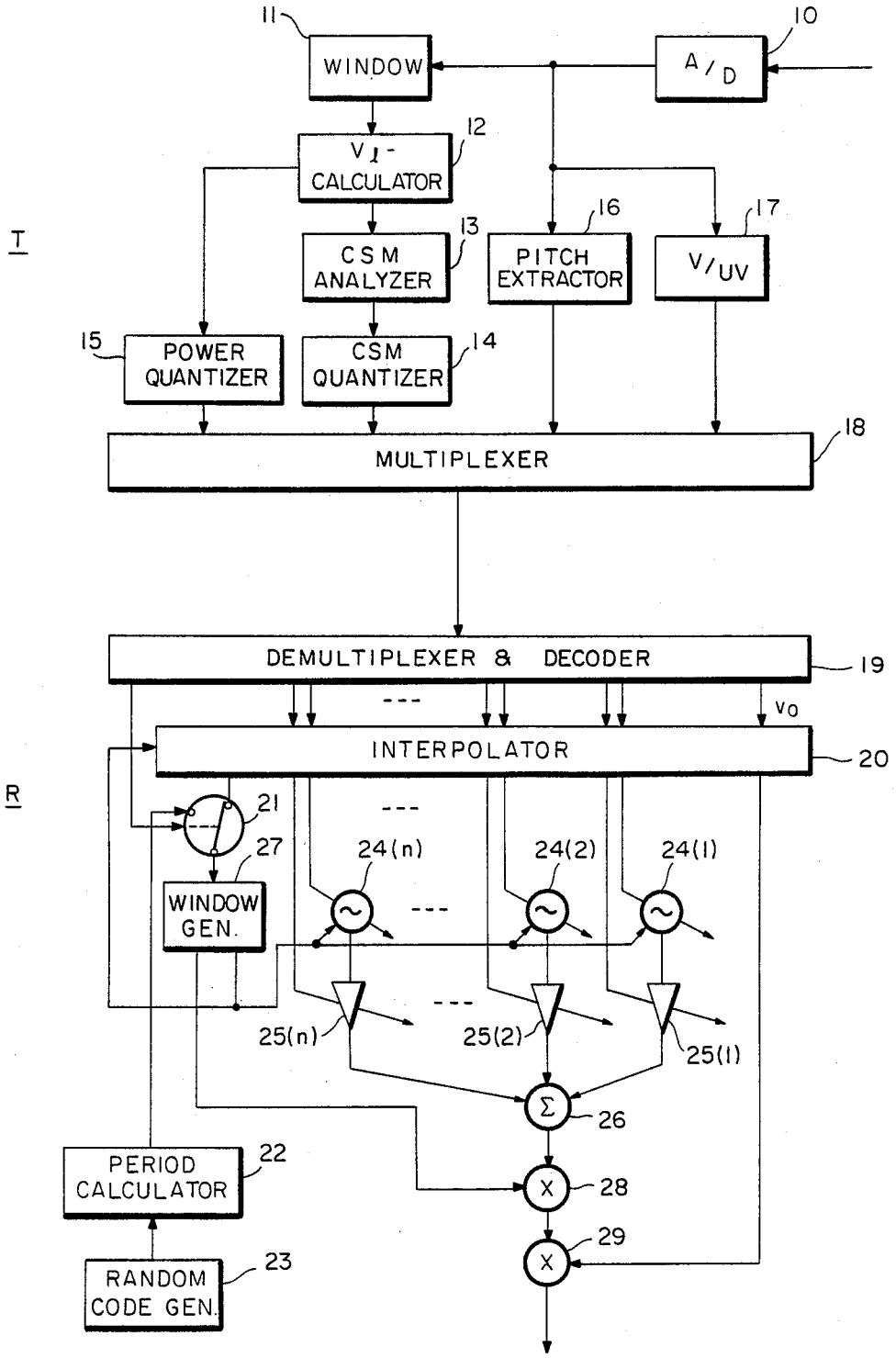
FIG. 1 is a block diagram of the basic construction of speech signal processor according to the invention.

FIG. 1 is a block diagram illustrating analyzer and synthesizer parts in an embodiment of the invention. The fundamental structure is composed of the transmitter part T where CSM analysis is performed and a receiver part R where reproduction of original speech on the basis of received CSM parameters is performed. Before making concrete description referring to FIG. 1, the basic principle of the invention will be described.

The number n, frequencies $\omega_i$ (i=1, 2, . . . , n), and amplitudes $m_i$ of sinusoidal waves to be combined and the CSM synthesized wave $y_t$ are related by $$y_t = \sum_{i=1}^{n} \sqrt{m_i}\ \sin(\omega_i t + \phi_i),$$

$r_l$ representing the autocorrelation coefficient of tap l is easily given by $$r_l = \sum_{i=1}^{n} m_i \cos l\omega_i.$$

Letting $x_t$ be a sample of the speech signal, the autocorrelation coefficient $v_l$ of tap l is:

$$v_l = \frac{1}{M} \sum_{t=l}^{M-1} x_t x_{t-l},$$

where M is the number of samples per analysis frame.

CSM analysis determines $m_i$ and $\omega_i$ so that $r_l$ is equal to $v_l$ with respect to the N lower orders, namely, $r_l = v_l (l=0, 1, 2, \ldots, N)$. The concrete description of this method will be given later. Herein it is assumed that $m_i$ and $\omega_i$ are in sequence obtained in response to given speech signals every analysis frame.

Figure 2:
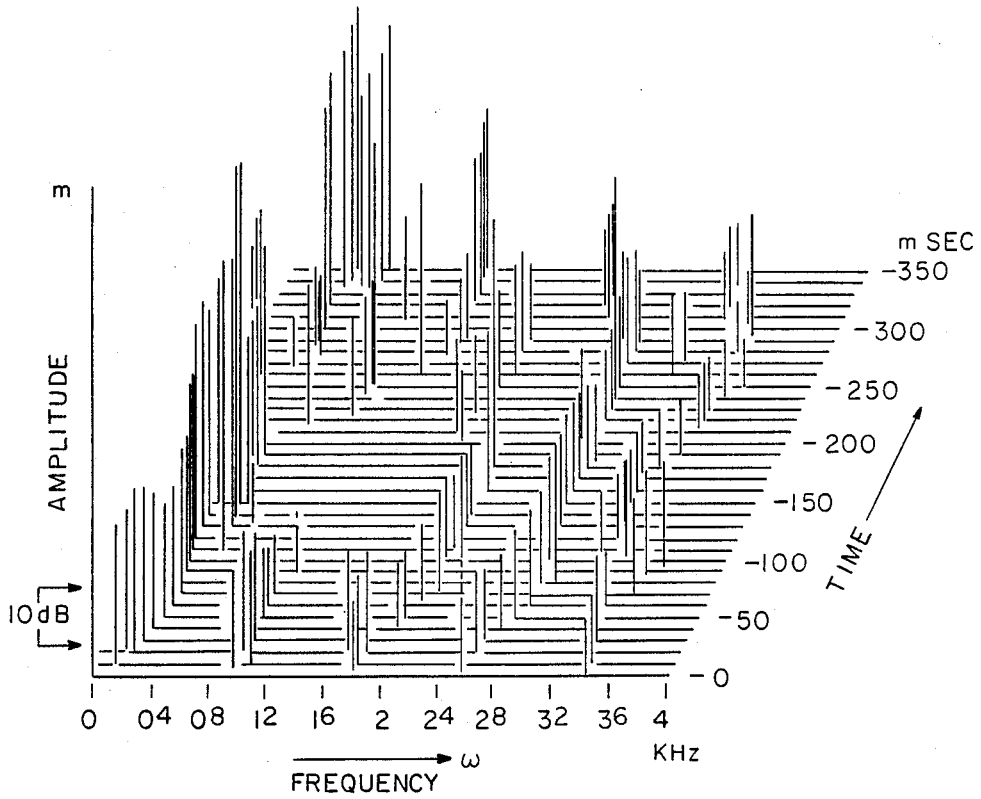
FIG. 2 is an example of speech characteristic of vector pattern showing the relationship among CSM parameter $m_i$, $\omega_i$ and time.

FIG. 2 shows a speech characteristic vector pattern giving the relationship between the thus obtained CSM parameters, $m_i$ and $\omega_i$ depending on time.

Figure 3:
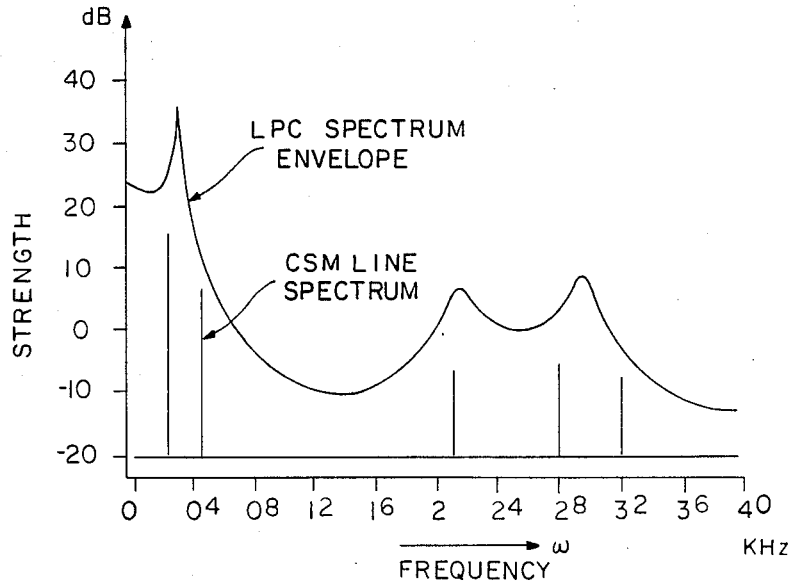
FIG. 3 is a graph showing the relationship between CSM line spectrum and LPC spectrum envelope obtained from the same speech sample.

FIG. 3 shows the CSM (the number of sinusoidal waves n=5) line spectrum of the 9th order (N=9) and the 9th-order LPC spectrum envelop obtained from the same sample (frequency transmission characteristic of LPC synthesis filter).

As described later, the order N is related to the number of sinusoidal waves by $N=2n-1$. From these drawings, it can be suspected that CSM contains characteristic information extracted from the original speech.

Figure 4A:
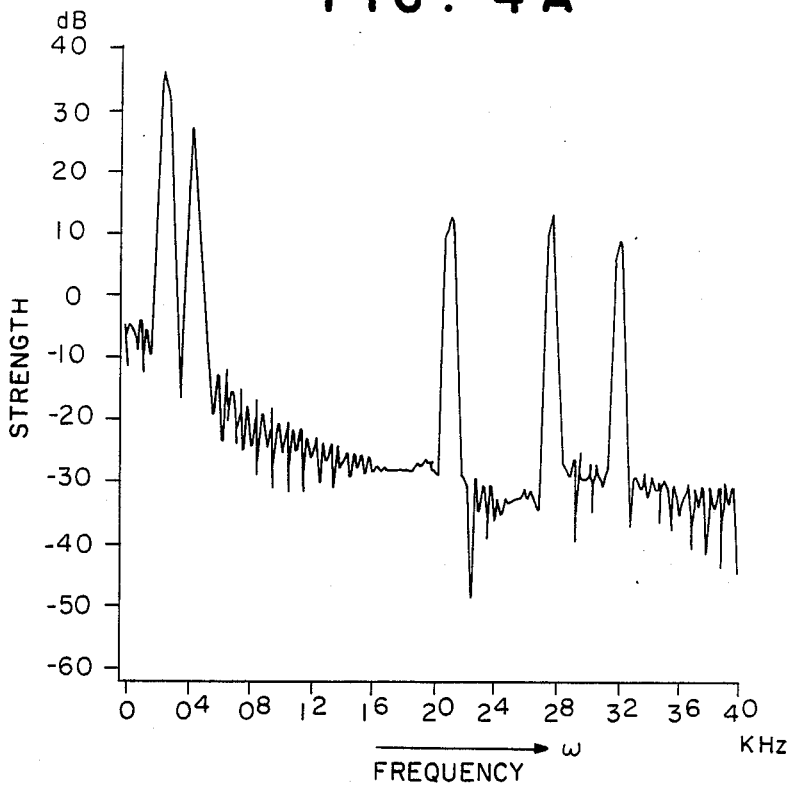
FIGS. 4A and 4B are a spectrum distribution graph reflecting the summation of a set of sinusoidal wave signals yielded by CSM analysis, and a spectrum distribution graph associated with the frequency spread caused by phase-resetting of the sinusidal signals, respectively.

Even if, however, n sinusoidal waves obtained by using values of n parameter set ($m_i$, actual amplitude being $\sqrt{m_i}$ as above-mentioned, and $\omega_i$) yielded by CSM analysis are simply combined (summed), the obtained synthesized sound can not be heard as the original speech. The simple combination of such sinusoidal waves generates the signal exhibiting a spectrum having n discrete lines as shown in FIG. 4A. On the other hand, the spectrum of the speech signal has a continuous spectrum envelope. Voiced speech is represented by pitch structure and unvoiced speech has fine spectral structure represented by stochastic process. Therefore, to synthesize speech or to obtain continuous spectrum by the CSM technique, spreading the line spectrum is required, in other words, it is required to change the speech spectrum pattern characterized by the line spectrum to the corresponding speech spectrum pattern.

According to the invention, the above-mentioned spectrum spreading for CSM speech synthesis is accomplished by the following procedure:

For the voiced speech which has a distinct pitch structure, the phase initialization is performed, that is, n sinusoidal waves specified by $m_i$ and $\omega_i$ as above-stated are reset with respect to phase every pitch period. This simply enables generation of the spectrum envelop and fine pitch spectrum structure. For the unvoiced speech, the phase initialization is performed by random codes having the upper and lower limits of the distribution.

Further, a time window processing which will be well described in the description of the embodiment is applied to the above-stated phase initialization to eliminate the discontinuity of synthesized waveform observed at the time of the phase resetting.

Figure 4B:
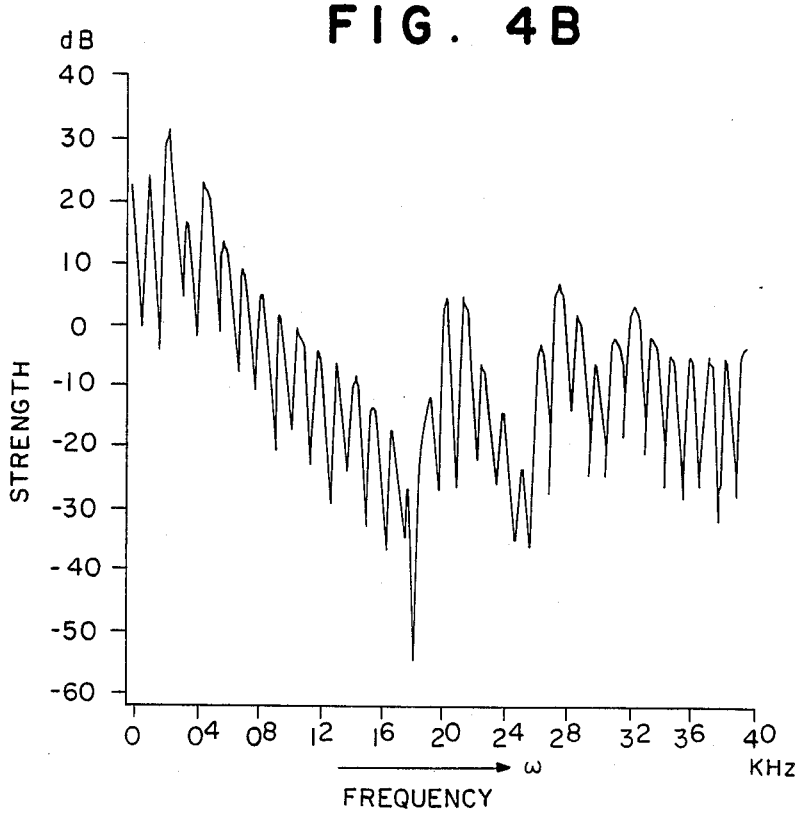

In this way, the CSM line spectrum shown in FIG. 4A is changed by spreading to the corresponding spectrum having the spectrum envelope and fine pitch structure as shown in FIG. 4B, which has been demonstrated by experimental results to ensure the reproduction of speech quality audible satisfactorily from the view point of practical use.

The above-stated method of CSM synthesis can be satisfactory audibly for practical use, and requires no filters, which makes consideration of the stability of the synthesis part (synthesis filter) unnecessary and produces better speech quality than that of a vocoder under the poor transmission performance of a channel.

Returning to FIG. 1, the transmitter part T comprises an A/D converter 10, a Hamming window processor 11, an autocorrelation coefficient calculator 12, a CSM analyzer 13, a CSM quantizer 14, a power quantizer 15, a pitch extractor 16, a voiced/unvoiced (V/UV) discriminator 17, and a multiplexer 18.

The receiver part R comprises a combined unit of demultiplexer and decoder 19, an interpolator 20, a V/UV switch 21, a period calculator 22, a random code generator 23, n variable frequency oscillators with phase resetting function 24(1), 24(2), . . . . , 24(n), n variable gain amplifiers 25(1), 25(2), . . . . , 25(n), a combiner 26, a variable length window function generator 27, and multipliers 28 and 29.

The speech waveform is converted into digital data quantized in respect to amplitude and time in the A/D converter 10. The digital data output is supplied to the Hamming window processor 11, the pitch extractor 16 and the V/UV discriminator 17, respectively.

Digital data supplied to the Hamming window processor 11 is subjected to weighting multiplication by a known Hamming window function every predetermined frame, and then applied in sequence to the autocorrelation coefficient calculator 12. The autocorrelation coefficient calculator 12 yields the lowest N orders autocorrelation coefficients $v_l$ (l=0, 1, 2, . . . . , N) using the above-described operation expressed by the equation $$v_l = \frac{1}{M} \sum_{t=l}^{M-1} x_t x_{t-l}$$

where $x_t$ (t=0, 1, . . . . , M−1) denotes 1 frame data.

The thus obtained $v_l$ of each frame are applied to the CSM analyser 13, and $v_0$ $$\left( \text{i.e., } v_0 = \frac{1}{M} \sum_{t=0}^{M-1} x_t^2 \right)$$

out of them to the power quantizer 15 to provide power information about the frame.

In the CSM analyzer 13 having received autocorrelation coefficient $v_l$ of each frame, the operation described later is made to determine amplitudes $m_i$ and frequencies $\omega_i$ (i=1, 2, . . . . , n) of n sinusoidal waves by the CSM synthesis of the frame, the resulting outputs being applied to CSM quantizer 14.

The CSM quantizer 14 quantizes the series of sinusoidal waves specified by $m_i$ and $\omega_i$ at an appropriate quantization step, which is chosen taking requirements for reproduced speech quality and transmission capacity of the transmission channel into consideration, and its outputs are supplied to the multiplexer 18. Also in the power quantizer 15 receiving $v_0$, quantization is performed at an appropriate quantization step chosen from a similar view point, and the output from this is applied to the multiplexer 18. The pitch extractor 16 extracts pitch period from the digital data from the A/D converter 10 and applies it to the multiplexer 18. The V/UV discriminator 17 discriminates whether the digital data indicates voiced or unvoiced speech and applies the result in the form of binary signals to the multiplexer 18. The multiplexer 18 combines these signals and transmits the combined signals through the transmission channel.

At the receiver part R, the thus-transmitted coded signals are decoded and separated in the combined unit of demultiplexer and decoder 19. The decoded signals are applied to an interpolator 20. In response to the interpolated $\omega_i$ (107 $_1$ through $\omega_n$) of n CSM waves, the output frequencies of the n variable frequency oscillator with phase resetting function 24(1) through 24(n) are controlled.

Besides, $m_1$ through $m_n$ specifying amplitudes of n CSM waves are applied to gain control terminals of the n variable gain amplifiers 25(1) through 25(n), and thereby oscillation powers of the frequencies are controlled to be specified values. The thus-obtained n outputs are combined or summed in a combiner 26 and the combined signal is applied to the multiplier 28. The pitch period information from the combined unit 19 of demultiplexer and decoder is applied to the V/UV switch 21, if desired, through the interpolator 20.

Random code signal generated from the random code generator 23 are converted into uniformly-distributed random code signal such that the distribution band and its lower limit, namely the upper and lower limit values are specified values in the period calculator 22. Then, the random codes are applied to the V/UV switch 21 as a data sequence to determine the phase-reset timing for unvoiced speech. As stated above, according to the invention, the phase initialization is performed in accordance with the uniformly-distributed random codes ranged between the specified upper and lower limit values and this enables the formation of an appropriate spectrum envelope. The random code generator 23 and period calculator 22 are described more fully below.

The binary signal (V/UV) from the combined unit 19 of demultiplier and decoder, which indicates whether voiced or unvoiced speech, is supplied as switching control signal to the switch 21. If the binary signal indicates voiced speech, the switch 21 supplies the above-mentioned pitch period fed from the interpolator 20 to the window function generator 27. On the other hand, the switch 21 supplies the random time interval generated by the period calculator 22 to the window function generator 27 if the binary signal indicates unvoiced speech.

Figure 5A:
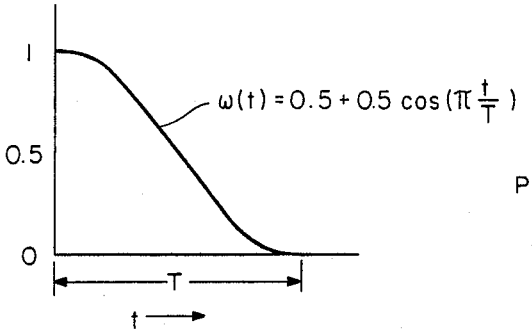
FIGS. 5A and 5B are waveforms of the outputs of the window function generator 27 shown in FIG. 1.
Figure 5B:
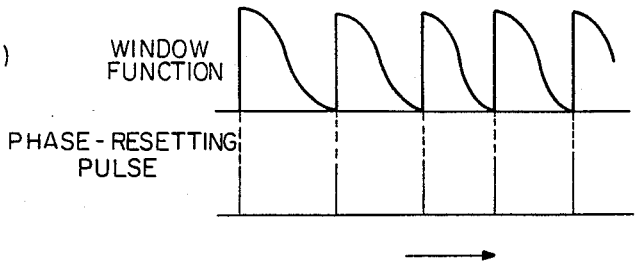

The window function generator 27 generates window functions for phase resetting, which eliminates discontinuity appearing in the output waveform and phase resetting pulses as shown in FIGS. 5A and 5B.

As mentioned above, data sequence designating intervals between phase resetting pulses is supplied one after another through the switch 21 to the window function generator 27, which generates one after another impulses having time intervals designated by the data sequence. These impulses are applied to the phase reset terminals of the variable frequency oscillators 24(1)

through 24(n) for phase initialization. The output of the window function generator 27 is applied also to the interpolator 20 and used as timing signals for interpolating angular frequency data $\omega_i$ and strength data $m_i$.

The window function generator 27 generates, in synchronism with the phase resetting pulse, the following variable length window function W(t). Let the interval between phase resetting pulses be T and the lapsed time from occurrence of the preceding phase resetting pulse be t, the generated window function W(t) is expressed as $$W(t) = 0.5 + 0.5 \cos\left(\pi \frac{t}{T}\right)$$

where $0<t<T$. The window function W(t) is shown in FIG. 5A. T value indicates the pitch period for voiced speech, and the variable generated in the probability process for unvoiced speech. The window function W(t) has therefore variable length and is synchronous with the aforesaid phase resetting pulse. In other words, starting and terminating timings of the window function coincides with those of the phase resetting pulse.

In response to the thus-generated window function, the multiplier 28 outputs are products of n sinusoidal waveforms having been combined in the combiner 26 and the above-mentioned window functions W(t) generated in synchronism with the every phase resetting pulse. The waveforms of the outputs are converged continuously to "0", as the result of multiplication by the window function W(t) before each sinusoidal wave is phase reset. Besides, at the time point of phase resetting, each sinusoidal wave rises from "0" which ensures continuity of the waveform.

The multiplier 29 multiplies the output of the multiplier 28 by the power information of each frame applied thereto and generates a synthetic speech.

As described above, in the embodiment according to the invention, the CSM synthesis necessary for speech reproduction is performed at the receiver part R and good sound quality can be reproduced irrespective of the amount of data in compression and error in the transmission line.

The interpolation of the transmission data in the interpolator 20 can be performed in various ways in accordance with the quantization step of the transmission data at the transmitter part T. For example, linear and more complicate function interpolations are usable. Further, interpolation with respect to $\omega_i$ and $m_i$ can be accomplished advantageously by choosing the interpolation point for permitting interpolation data to be given every time at the point of generation of the phase resetting pulse. For insuring renewal of $\omega_i$ and $m_i$ values at this timing, phase limitting pulses are applied to the interpolator 20.

Thus, in actual processing, for example, resetting of phase and setting of frequencies $\omega_i$ in the oscillators 24(1) to 24(n), and setting of amplitude $m_i$ in the amplifiers 25(1) to 25(n), can be performed at different times. As a countermeasure against this, the interpolator 20 is provided with a memory for storing necessary data.

The next description concerns analysis by the CSM analyzer 13. CSM analysis is performed to determine frequencies $\omega_i$ and strengths or power amplitudes $m_i$ at every analysis frame so that the lowest N order tap values of the autocorrelation coefficients directly calculated from the speech waveform is equal to the lowest N order tap values of the synthsized wave consisting of n sinusoidal waves.

As described above, the autocorrelation coefficient $r_l$ of tap l is represented as $$r_l = \sum_{i=1}^{n} m_i \cos l \cdot \omega_i.$$

Further, the autocorrelation coefficient $v_l$ of tap l for a certain frame is expressed by using speech samples $x_t$ as follows:

$$v_l = \frac{1}{M} \sum_{t=l}^{M-1} x_t x_{t-l} \tag{1}$$

By the use of the relationship $$r_l = v_l \tag{2}$$

where $l=0,1,\ldots,N$ ($N=2n-1$), the following matrix is obtained:

$$\begin{bmatrix} 1 & 1 & 1 \\ \cos\omega_1 & \cos\omega_2 & \cos\omega_n \\ \cos 2\omega_1 & \cos 2\omega 2 & \cos 2\omega_n \\ \cdot & \cdot & \cdot \\ \cdot & \cdot & \cdot \\ \cdot & \cdot & \cdot \\ \cos(2n-1)\omega_1 & \cos(2n-1)\omega_2 & \cos(2n-1)\omega_n \end{bmatrix} \begin{bmatrix} m_1 \\ m_2 \\ \cdot \\ \cdot \\ \cdot \\ m_n \end{bmatrix} = \begin{bmatrix} v_0 \\ v_1 \\ \cdot \\ \cdot \\ \cdot \\ v_{2n-1} \end{bmatrix} \tag{3}$$

The matrix can not be solved by simple matrix operation owing to the unknown $\omega_i$ and $m_i$ included in it. Therefore, using $$\omega_i = \cos^{-1} X_i \tag{4}$$

the substitution as $$\cos l\omega_1 = \cos(l\cos^{-1}X_i) - 5T_l(X_i) \tag{5}$$

is made. The $T_1(X)$ is a Tchebycheff polynominal. Thus equation (3) may be expressed as $$\begin{bmatrix} T_0(x_1) & T_0(x_2) & \cdots & T_0(x_n) \\ T_1(x_1) & T_1(x_2) & \cdots & T_1(x_n) \\ T_2(x_1) & T_2(x_2) & \cdots & T_2(x_n) \\ \cdot & \cdot & & \cdot \\ \cdot & \cdot & & \cdot \\ \cdot & \cdot & & \cdot \\ T_{2n-1}(x_1) & T_{2n-1}(x_2) & \cdots & T_{2n-1}(x_n) \end{bmatrix} \begin{bmatrix} m_1 \\ m_2 \\ \cdot \\ \cdot \\ \cdot \\ m_n \end{bmatrix} = \begin{bmatrix} v_0 \\ v_1 \\ v_2 \\ \cdot \\ \cdot \\ \cdot \\ v_{2n-1} \end{bmatrix} \tag{6}$$

Generally, $X^l$ can be related to $T_O(x)$, $T_1(x)$, . . . , $T_l(x)$, as linear summation expressed by $$X^l = \sum_{j=0}^{l} S_j^{(l)} T_j(x) \tag{7}$$

where $S_j^{(l)}$ is inverse Tchebycheff coefficient. Using $S_j^{(l)}$, linear summation $A_1$ of the above-mentioned sample autorelation coefficient $v_j$ is defined by $$A_l = \sum_{i=0}^{l} S_j^{(l)} \cdot v_j \tag{8}$$

$$(l = 0, 1, 2, \ldots, 2n-1)$$

Using equations (7) and (8) in the left and right sides of equation (6), gives $$\begin{bmatrix} x_1^0 & x_2^0 & \cdots & x_n^0 \\ x_1^1 & x_2^1 & \cdots & x_n^1 \\ x_1^2 & x_2^2 & \cdots & x_n^2 \\ \vdots & \vdots & & \vdots \\ x_1^{2n-1} & x_2^{2n-1} & \cdots & x_n^{2n-1} \end{bmatrix} \begin{bmatrix} m_1 \\ m_2 \\ \vdots \\ m_n \end{bmatrix} = \begin{bmatrix} A_0 \\ A_1 \\ A_2 \\ \vdots \\ A_{2n-1} \end{bmatrix} \tag{9}$$

Subsequently, the n-th degree polynominal having "0" point at $x_1, x_2, \ldots, x_n$ defined as $$P_n(x) \equiv \sum_{k=0}^{n} P_k^{(n)} X^k = \prod_{i=1}^{n} (N - X_i)$$

Using the defined $P_n(x)$ gives $$\sum_{i=0}^{n} m_i P_n(X_i) X_i$$

It is apparent that the above equation becomes "0". It can be rewritten as $$\begin{aligned} 0 &= \sum_{i=1}^{n} m_i P_n(x_i) x_i^l = \sum_{i=1}^{n} m_i \sum_{k=0}^{n} P_k^{(n)} x_i^{k+l} \\ &= \sum_{k=0}^{n} P_k^{(n)} \sum_{i=1}^{n} m_i x_i^{k+l} = \sum_{k=0}^{n} P_k^{(n)} A_{k+l} \end{aligned}$$

Thus, assuming l=0, 1, 2, . . . , n gives $$\begin{bmatrix} A_0 & A_1 & \cdots & A_n \\ A_1 & A_2 & \cdots & A_{n+1} \\ \vdots & \vdots & & \vdots \\ A_n & A_{n+1} & \cdots & A_{2n} \end{bmatrix} \begin{bmatrix} P_0^{(n)} \\ P_1^{(n)} \\ \vdots \\ P_{n-1}^{(n)} \\ P_n^{(n)} \end{bmatrix} = 0$$

Taking $p_n^{(n)} = 1$, it follows that $$\begin{bmatrix} A_0 & A_1 & \cdots & A_{n-1} \\ A_1 & A_2 & \cdots & A_n \\ \vdots & \vdots & & \vdots \\ A_{n-1} & A_n & \cdots & A_{2n-2} \end{bmatrix} \begin{bmatrix} p_0^{(n)} \\ p_0^{(n)} \\ \vdots \\ p_{n-1}^{(n)} \end{bmatrix} = - \begin{bmatrix} A_n \\ A_{n+1} \\ \vdots \\ A_{2n-1} \end{bmatrix}$$

The matrix involving $A_i$ in the left side is generally termed the Hankel matrix. As above-stated, $A_i$ is obtained by using equation (8) from sample autocorrelation coefficient $v_j$ of the speech waveform to be expressed and hence known. Accordingly, $P_0^{(n)}$, $P_1^{(n)}$, . . . $P_{n-1}^{(n)}$ can be obtained by solving equation (10).

On substituting the obtained $p_i^{(n)}$ values into the n-degree equation $$P_n(x) = x^n + p_{n-1}^{(n)} x^{n-1} + \ldots p_0^{(n)} = 0$$

Thus $\{x_1, x_2, \ldots, x_n\}$ can be yielded.

Using these values gives CSM frequencies $\omega_i$ in accordance with equation (4): $\omega_{cos}^{-1} x_i$. Likewise, CSM amplitudes $m_i$ can be obtained according to the equation which is derived from equation (9), expressed by $$\begin{bmatrix} 1 & 1 & \cdots & 1 \\ x_1 & x_2 & \cdots & x_n \\ \vdots & \vdots & & \vdots \\ x_1^{n-1} & x_2^{n-1} & \cdots & x_n^{n-1} \end{bmatrix} \begin{bmatrix} m_1 \\ m_2 \\ \vdots \\ m_n \end{bmatrix} = \begin{bmatrix} A_0 \\ A_1 \\ \vdots \\ A_{n-1} \end{bmatrix}$$

The matrix of the left side of the equation is generally termed the Vander Monde matrix.

In summary, algorithm of CSM analysis is as follows:

(1) Computation of autocorrelation coefficients in accordance with the equation $$v_l = \frac{1}{M} \sum_{t=l}^{M-1} x_t x_{t-l}$$

(2) Computation of Al using the inverse Tchebycheff coefficient at $$A_l = \sum_{j=0}^{l} S_j^{(l)} v_j$$

(3) Computation of $P_i^{(n)}$ by solving the Hankel matrix equation of $A_l$ $$\begin{bmatrix} A_0 & A_1 & \cdots & A_{n-1} \\ A_1 & A_2 & \cdots & A_n \\ \vdots & \vdots & & \vdots \\ A_{n-1} & A_n & \cdots & A_{2n-2} \end{bmatrix} \begin{bmatrix} p_0^{(n)} \\ p_1^{(n)} \\ \vdots \\ p_{n-1}^{(n)} \end{bmatrix} = - \begin{bmatrix} A_n \\ A_{n+1} \\ \vdots \\ A_{2n-1} \end{bmatrix}$$

(4) For n $x_i$, solution of the n-th degree algebraic equation having as coefficients $$P_n(x) \equiv x^n + p_{n-1}^{(n)} x^{n-1} + p_{n-2}^{(n)} x^{n-2} + \ldots + p_1^{(n)} x + p_0 = 0$$

(5) For CSM angular frequencies $\omega_i$, performing the operation as $$\omega_i = \cos^{-1} X_i$$

(6) For CSM amplitudes $m_i$, solution of the Vander Monde matrix equation $$\begin{bmatrix} 1 & 1 & 1 \\ x_1 & x_2 & x_n \\ x_1^2 & x_2^2 & x_n^2 \\ \cdot & \cdot & \cdot \\ \cdot & \cdot & \cdot \\ \cdot & \cdot & \cdot \\ x_1^{n-1} & x_2^{n-1} & \cdots x_n^{n-1} \end{bmatrix} \begin{bmatrix} m_1 \\ m_2 \\ m_3 \\ \cdot \\ \cdot \\ \cdot \\ m_n \end{bmatrix} = \begin{bmatrix} A_0 \\ A_1 \\ A_2 \\ \cdot \\ \cdot \\ \cdot \\ A_{n-1} \end{bmatrix}$$

These processing steps give CSM frequencies $\{\omega_1, \omega_2, \ldots, \omega_n\}$ and CSM amplitudes $\{m_1, m_2, \ldots, m_n\}$. There is known a method of sequentially solving by providing initial condition, as an efficient solution of the Hankel matrix. The above-mentioned n-th degree algebraic equation has proved to have real roots only, and therefore can be solved, for example, by the Newton & Lapson's method. Also, it is possible to use the method of solving in sequence by conversion into triangular matrix as an efficient solution of the Vander Monde matrix equation.

It is to be understood the embodiment of the invention described above of does not limit the invention. While the above embodiment of the invention comprises the parameter interpolation by the interpolator at the time point of phase resetting, this step may be omitted. In a preferred embodiment of the invention, instead of the variable length window function of a specified form, of course other function forms can be used.

Figure 6:
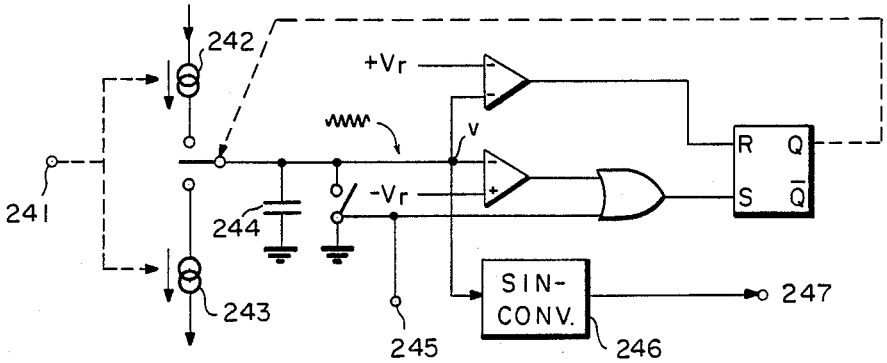
FIGS. 6 is a detailed block diagram of a variable frequency oscillator 24 shown in FIG. 1.

FIG. 6 shows an example of circuitry of variable frequency oscillator 24 with a phase resetting function. A voltage is applied to a frequency control terminal 241, and thus a constant current is caused to flow through constant current power supplies 242 and 243, whereby current for charging or discharging capacitor 244 is controlled, and by virtue of this, the oscillation frequency is variable. At point "v", there is generated a triangular waveform varying linearly between standard voltages $+V_r$ and $-V_r$. Upon applying an impulse to a phase reset terminal 245, point v is caused to be instantly grounded and returned to zero potential. The triangular wave output is supplied to a sinusoidal wave converter 246 to generate a sinusoidal wave from a terminal 247. The sinusoidal wave converter 246 can be easily realized for example, by the method of reading sinusoidal functions stored in ROM, in the form of input waveform. Such a variable frequency oscillator with a phase resetting function can simply be realized with a computer program.

Figure 7:
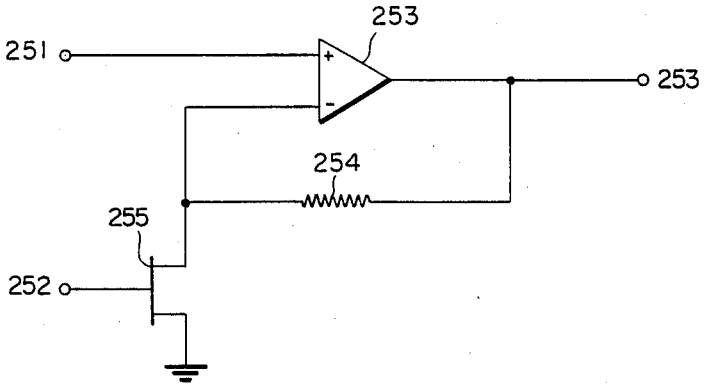
FIG. 7 is a detailed block diagram of a variable gain amplifier 25 of FIG. 1.

FIG. 7 shows an example of circuitry of a variable gain amplifier 25. A signal to be amplified is applied to a terminal 251 and a control signal to another terminal 252 to control the gain of the operational amplifier 253. The control signal supplied to an FET 255 controls the current in the resistor 254, thereby controlling the gain of the amplifier 253.

Figure 8:
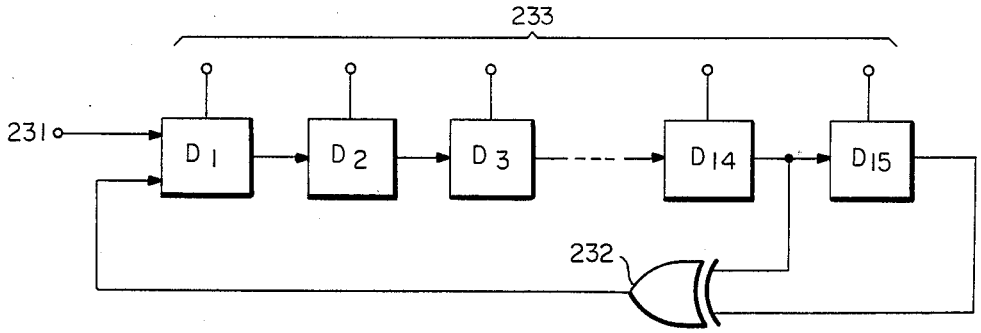
FIG. 8 is a detailed block diagram of a random code generator 23 shown in FIG. 1.

In FIG. 8, an example of circuitry of the random code generator 23 is shown, which comprises a 15-stage register array $D_1, D_2, \ldots, D_{15}$ and an exclusive-OR circuit 232 and generates a pseudo random code of the next 15-order M sequence having synchronism number of $2^{15}-1$. At a necessary point of time, a shift pulse is applied to a clock terminal 231 and thus the next random code value is output from an output terminal group 233. In the example shown in FIG. 8, a 15-order M sequence is generated from the output terminal group 233, and integers 1 to 32767 are generated once per period.

Figure 9A:
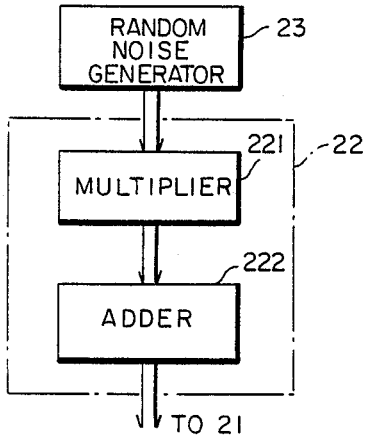
FIGS. 9A and 9B are a detailed block diagram of a period calculator 22 shown in FIG. 1 and a distribution diagram of its output, respectively.

FIG. 9A is a block diagram of the period calculator 22, which comprises a constant multiplier 221 and a constant adder 222, and which converts random codes uniformly distributed in the range of 1 to 32767 from the random code generator 23 into the codes having distribution suitable for use in specifying time intervals of the phase-resetting phase for unvoiced speech.

Figure 9B:
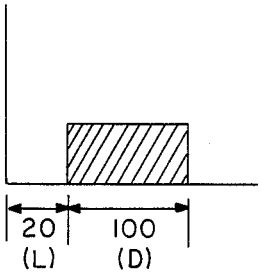

The constant multiplier 221 operates to multiply the output data (1 to 32767) from the random generator 23 by a constant ($3.052 \times 10^{-3}$ in the embodiment) to output uniformly-distributed data of 0–100. Then, the process for yielding fractional points is made. The output of the constant multiplier 221 is applied to the constant adder 222, and there a constant (20 in the embodiment) is added to the respective data 0 to 100. Thus data uniformly distributed over the range of 20 to 120 is obtained and used as a random interval (initial phase intervals) for unvoiced speech generation. According to the above described processings, an appropriate distribution range, having for example the distribution width D=100 and the lower limit L=20 of random codes, as illustrated in FIG. 9B, can be obtained. In this way, good unvoiced speech is produced by phase initialization using the random code signal.

Figure 10:
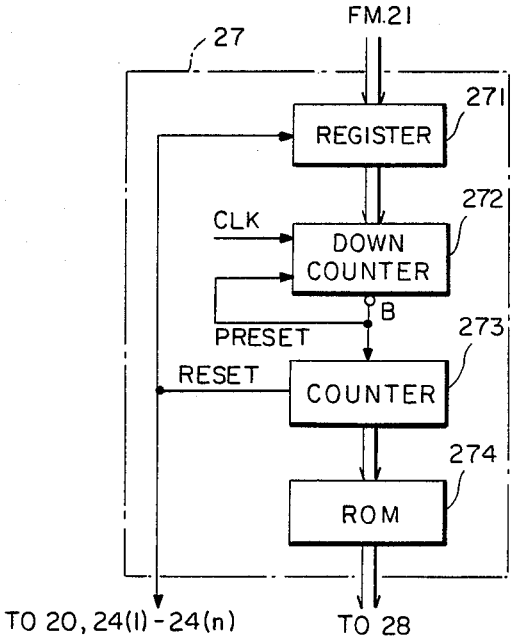
FIG. 10 is a detailed block diagram of a window function generator 27 shown in FIG. 1.

FIG. 10 gives a block diagram of an example of window function generator 27 which comprises a register 271, a presettable down counter 272, a counter 273 and a read only memory (ROM) 274.

Data P from a switch 21 for specifying the phase resetting pulse interval is stored in the register 271. The down counter 272, upon being preset to data P read from the register 271, starts to count down in operable association with a clock CLK. When the content of the counter 272 has become zero, a pulse is generated from the output (borrow) terminal "B", and applied to the down counter 272 and the counter 273. Thereby the initial value of the down counter 272 is represet to P, and down counting from the initial value is caused to start. As the result, at the output terminal B, a pulse train of a period proportional to interval P (for example, P/K, where K is the last address number set on a ROM 274) is generated. The pulse train is applied to a counter 273 as clocks. The count output of the counter 273 is applied as address to the ROM 274 to read out data of window function w(t), and the function w(t) read out is supplied to the multiplier 28. At the time point when the counter 273 has counted K pulses, the last data of window function on the ROM 274 is read out. Besides, the counter 273 is reset and consequently outputs resetting pulses. The resetting pulses are used as phase resetting pulses to be applied to the phase reset terminals of the oscillators 24(1) through 24(n) and the interpolator 20 as above-stated, and also applied to the register 271 to set the next input data (pulse interval). In this way, a phase resetting pulse specifying pulse intervals and variable length window functions w(t) synchronized with the pulse as shown in FIG. 5B are generated.

An alternative example according to the invention having an improved quantization efficiency will be described. The improvement in quantization efficiency can be achieved by the method of performing amplitude quantization, taking the interrelationship between CMS parameters into consideration.

Figure 11:
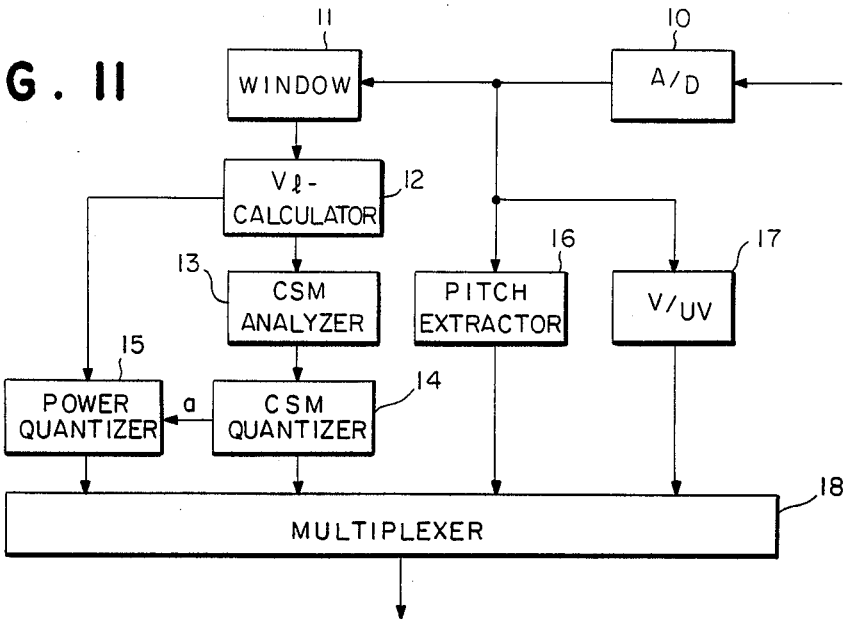
FIG. 11 is a block diagram of the structure of the transmitter part of an alternative embodiment according to the invention.

In FIG. 11 is diagrammed the structure of the transmitter part of the second example of which main composition are the same as in FIG. 1 except for difference in functions of CSM quantizer 14 and power quantizer 15. The difference will be described below.

The CSM quantizer 14 quantizes a series of normalized $m_i$ and a series of $\omega_i$ output from CSM analyzer 13 on the basis of normalization coefficients "a", $a=\max\{m_1, m_2, \ldots, m_n\}$ and applying "a" as correction data to the power quantizer 15. The number of bits for quantization is chosen appropriately, taking the requirement for reproduced speech quality and transmission capacity of channel into consideration. The CSM quantizer 14 supplies this quantized serieses of $m_i$ and $\omega_i$ to the multiplexer 18.

Figure 12:
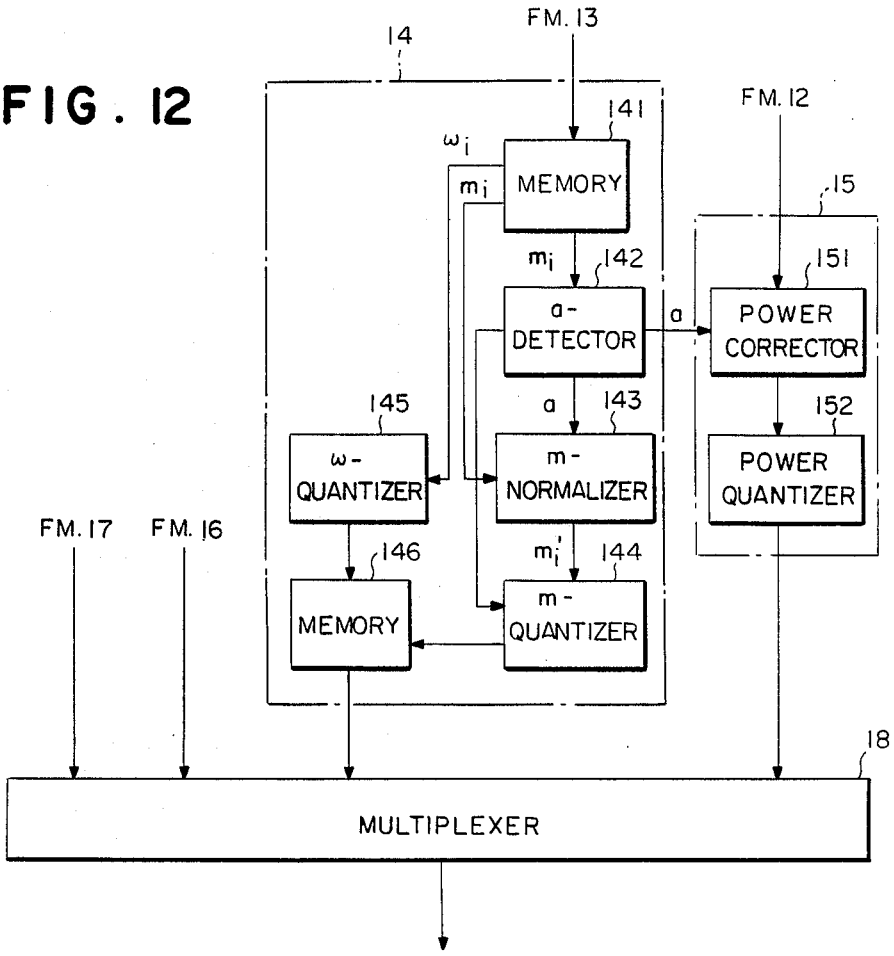
FIG. 12 is a detailed block diagram illustrating the functions of a CSM quantizer 14 and a power quantizer 15 shown in FIG. 11.

The power quantizer 15 receiving the normalization coefficients "a" and the power $v_0$ performs quantization of $v_0$ at suitable quantization steps determined from the above-described viewpoint is applied to the multiplexer 18. FIG. 12 is a block diagram concretely showing the CSM quantizer 14 and the power correction quantizer 15.

Sets of CSM parameters $\omega_i$ and $m_i$ $(i=1, 2, \ldots, n)$ from the CSM analyzer 13, which specify amplitudes and frequencies of n CSM sinusoidal waves, are applied to a temporary memory 141. A normalization coefficient detector 142 and a CSM amplitude normalizer 143 are provided with $m_i$ from the temporary memory 141. The normalization coefficient detector 142 detects the normalization coefficient, "a", and the number I giving the maximum amplitude of $m_i$ according to the procedure:

(1) Initial condition $a=m_1$, and $I=1$ are set.

(2) Comparison between a and $m_2$ is made.

If $a \geqq m_2$, (4) is carried out.

If $a<m_2$, (3) is carried out.

(3) $a=m_2$ and $I=2$ are set.

(4) Comparison between a and $m_3$ is made, and proceeded similarly to the process (2).

(5) The same procedure as process (4) is made with respect to the subsequent $m_4, \ldots, m_N$.

The normalization coefficient detector 142 supplies "a" to a power corrector 151 and a CSM amplitude normalizer 143, and supplies also I to a CSM amplitude quantizer 144. The CSM amplitude normalizer 143 normalizes $m_i$ by "a" according to, $m_i'=m_i/a$ $(i=1, 2, \ldots, n)$, the results to a CSM amplitude quantizer 144.

Figures 13A, 13B:
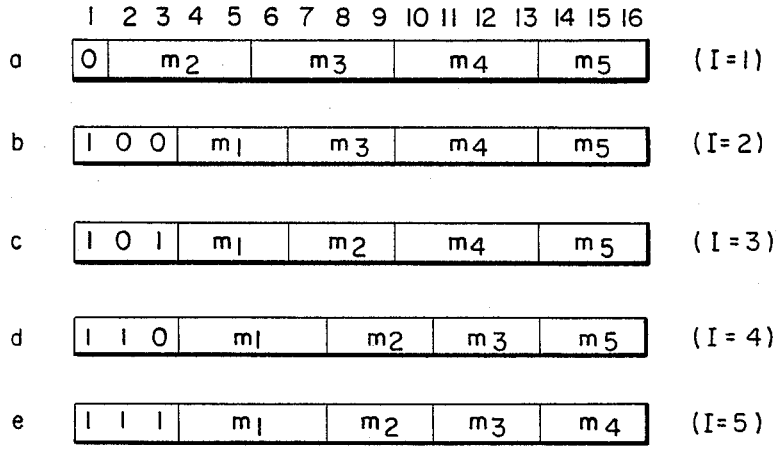
FIGS. 13A and 13B represent bit distribution and bit allocation, respectively, for explaining quantization of the CSM quantizer 14 shown in FIG. 11.

The CSM amplitude quantizer 144 performs linear quantization in bit distribution for example, as shown in FIGS. 13A and 13B, by the use of I and $\sqrt{m_i'}$ supplied from the normalization coefficient detector 142, and supplies the quantized data to the temporary memory 146.

The next description is of the mode of quantization referring to FIGS. 13A and 13B. FIG. 13A shows bit distribution for 16-bit quantizing CSM amplitudes $m_1$, $m_2$, $m_3$, $m_4$, $m_5$ obtained by an 9-th-order CSM analysis (corresponding to $n=5$). Corresponding to the number I, designation of the maximum CSM amplitude is made. In the case number I indicating the maximum CSM amplitude is 1, as a in FIG. 13B, "0" is given as the bit at the left end. When I is 2, 3, 4 or 5, "1" is given at the same location as shown in FIGS. 13B, b through e.

Referring to FIG. 13A in which 5 amplitudes $m_1$ through $m_5$ are given, $m_1$ is allocated 1 bit, and $m_2$ through $m_5$ 3-bit, respectively to specify the maximum amplitude. For the respective remaining amplitudes (excluding the maximum amplitude) is allocated 3 or 4 bits.

FIG. 13B-a, shows bit allocation when the maximum amplitude specifying number $I=1$ ($m_1$ is maximum amplitude), in which the first bit at the left end is "0". $m_2$ through $m_4$ are allocated 4 bits, and $m_5$ 3 bits. In FIG. 13B-b, the bit allocation when $I=2$ ($m_2$ is maximum amplitude) is shown, in which $m_2$ is indicated to be the maximum amplitude by the first 3 bits, and the remaining parameters $m_1$, $m_3$, and $m_5$ are allocated 3 bits and $m_4$ 4 bits. Likewise, $I=3$, 4, and 5, respectively, bit allocation is made as shown in FIG. 13B, c, d and e.

Now, according to the study on distribution of CSM amplitudes, most often, $m_1$ has maximum CSM amplitude. As shown in FIG. 13B, it is so designed that when $m_1$ is maximum amplitude, i.e. $I=1$, specification of I can be made with the smallest number of bits. The maximum CSM amplitude is normalized by itself, and so always becomes 1.0, this making transmission of information unnecessary.

Again referring to FIG. 12, the thus-quantized CSM amplitude parameters are output to a temporary memory 146. The CSM frequency quantizer 145 receives $\omega_i$ $(i=1, 2, \ldots, n)$, which specify a set of CSM frequencies of n sinusoidal waves, from a temporary memory 141 and then performs linear quantization taking the distribution range of $\omega_i$ previously investigated into consideration. The resulting output of quantized data is applied to the temporary memory 146. The temporary memory 146 outputs data of quantized CSM amplitudes and CSM frequencies to the multiplexer 18. A power corrector 151 performs multiplication of the power data from the autocorrelation coefficient calculator 12 by the coefficient "a" from the normalization coefficient detector 142, and the resulting output is applied to a power quantizer 152. The power quantizer 152 produces the square root of the input data, converts into amplitude information, and then performs, for example, nonlinear quantization used in $\mu$255 PCM. The resulting output is applied to the multiplexer 18. Further inverse normalization at the synthesis part is carried out automatically by the multiplier 29.

The description given subsequently is of a further embodiment according to the invention of a privacy telephone set having a high privacy based on the CMS technique involving the analysis and synthesis of speech.

The privacy telephone system according to the invention utilizes the feature that a simple combination of a plurality of sinusoidal waves having frequencies and amplitudes obtained by CSM analysis cannot be at all heard as speech, though they contain information necessary for speech reproduction in the most fundamental form.

At the transmitter part, the input speech signal is CSM-analyzed, and analog signal is produced by the simple combination of a plurality of sinusoidal waves having frequencies and amplitudes and is transmitted along a transmission channel. As described above, the synthesized (combined) waveforms have high privacy though they contain necessary information for reproducing speech. In particular, the privacy can be enhanced by a previously specified conversion of CSM parameters, as described later. At the receiver part, original speech is reproduced by a CSM speech synthesis as illustrated in FIG. 1 from frequencies and amplitudes obtained by frequency analysis of received signals.

Figure 14A:
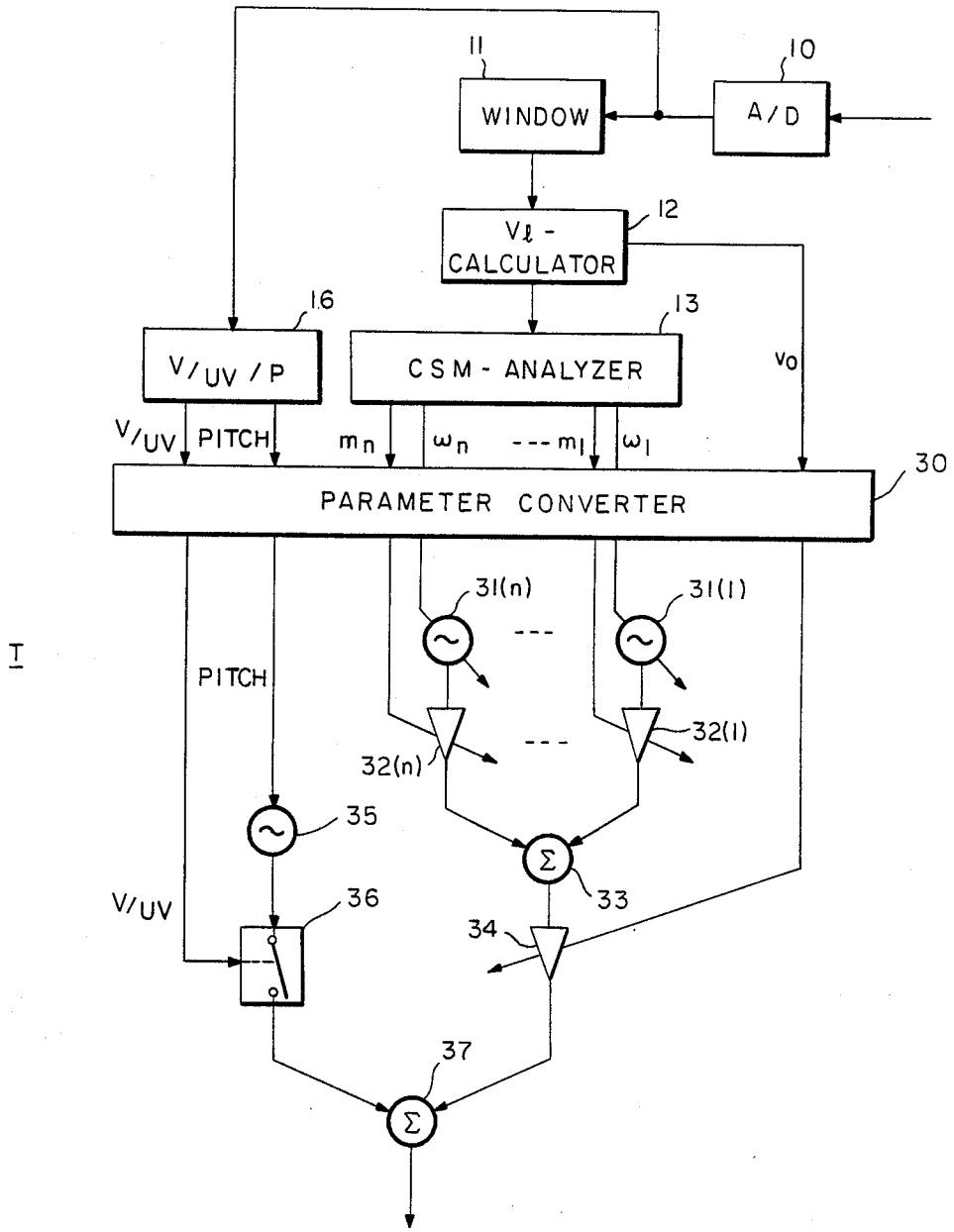
FIGS. 14A and 14B are structural block diagrams of a further embodiment in accordance with the invention.
Figure 14B:
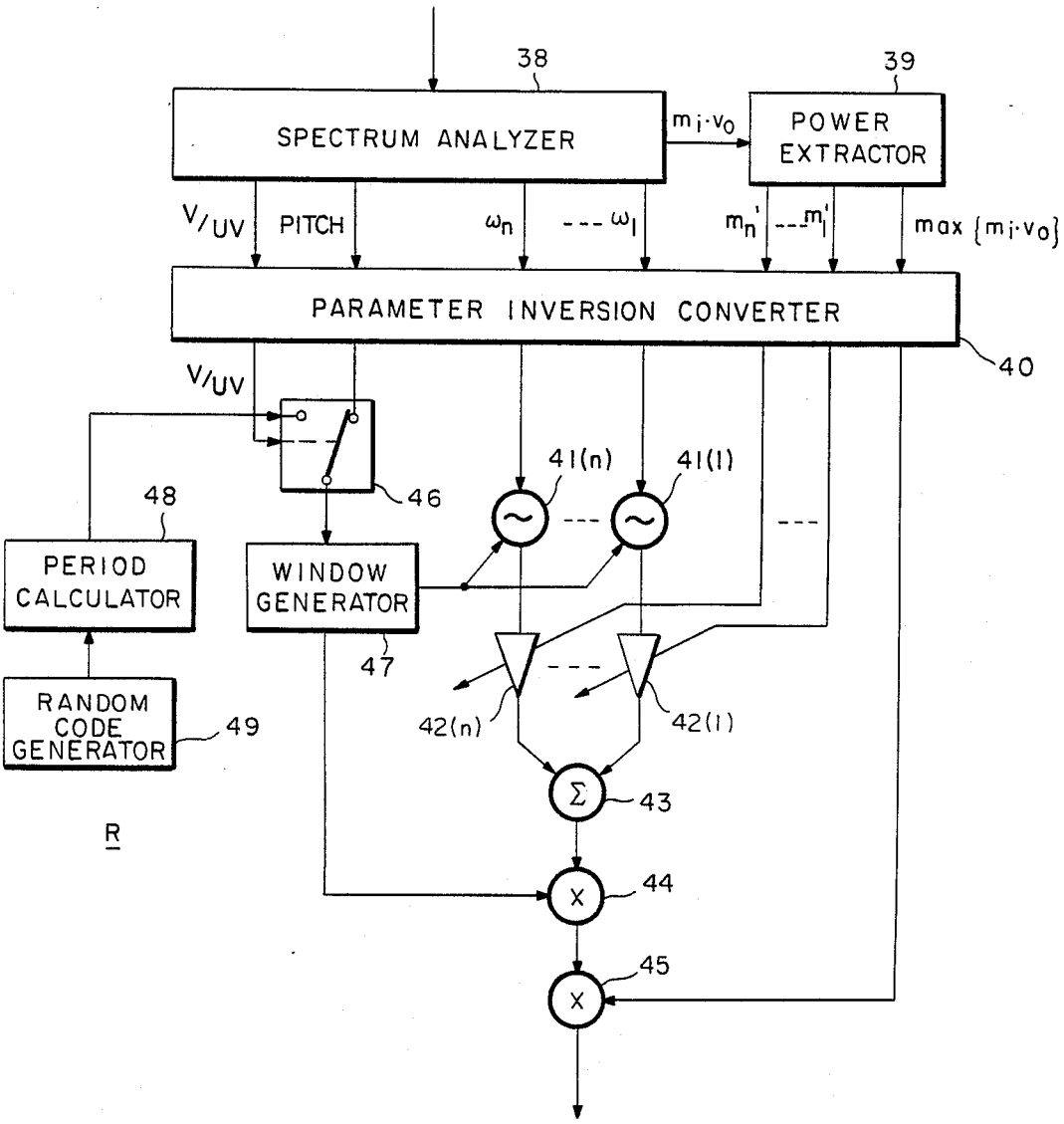

FIGS. 14A and 14B are block diagram showing this embodiment according to the invention.

The transmitter part T comprises a A/D converter 10, a Hamming window processor 11, an autocorrelation coefficient calculator 12, a CSM analyzer 13, a V/UV/Pitch (V/UV/P) analyzer 16, a parameter converter 30, n variable frequency oscillators 31(1) through 31(n), n variable gain amplifiers 32(1) through 32(n), a combiner 33, a variable gain amplifier 34, a variable frequency oscillator 35, a V/UV switch 36 and a combiner 37.

The receiver part R comprises a spectrum analyzer 38, a power extractor 39, a parameter inverse converter 40, n variable frequency oscillators with phase resetting function 41(1) through 41(n), n variable gain amplifiers 42(1) through 42(n), a combiner 43, multipliers 44 and 45, a V/UV switch 46, a variable length window function generator 47, a period calculator 48, and a random code generator 49.

The speech waveform to be transmitted, as in FIG. 1, is applied to the A/D converter 10 through input line for converting into digital data. The digital data is supplied to the Hamming window processor 11 and V/UV/P analyzer 16, respectively.

Digital data supplied to the Hamming window processor 11 is subjected to weighted- multiplication by a Hamming window function and then applied in sequence to the autocorrelation coefficient calculator 12.

The autocorrelation coefficient calculator 12 develops the lowest N orders of autocorrelation coefficients $v_l$ (l=0, 1, 2, . . . , N) by the above-described operation expressed by the equation $$v_l = \frac{1}{M} \sum_{t=l}^{M-1} x_t x_{t-l}$$

Where $x_t$ (t=0, 1, . . . , M−1).

The thus obtained $v_l$ of each frame are applied to the CSM analyzer 13, and $v_0$ $$\left( \text{i.e., } v_0 = \frac{1}{M} \sum_{t=0}^{M-1} x_t^2 \right)$$

out of them to the parameter converter 30 as power information.

The CSM analyzer 13 determines amplitudes $m_i$ and frequencies $\omega_i$ (i=1, 2, . . . , n) of an sinusoidal waves as described before and the result is applied to the parameter converter 30.

The V/UV/P analyzer 16 receives digital data of the original speech signals from the A/D converter 10 and extracts information of pitch frequency and voiced/unvoiced speech, the resulting output being applied to the parameter converter 30.

The parameter converter 30 performs parameter conversion of the input information. For easier understanding, the description is proceeded under the assumption that the input signal is output as it is, i.e. without undergoing any conversion by the converter.

Thus n frequency information $\omega_i$ output from the CSM analyzer 13 are applied to the variable frequency oscillators 31(1) through 31(n) via the converter 30 to specify their oscillation frequencies. On the other hand, n amplitudes $m_i$ output from CSM analyzer 13 are applied as gain control informations to the variable gain amplifiers 32(1) through 32(n) likewise via the converter 30 to specify the outputs of the oscillators 31(1) through 31(n).

Thus, synthesized waveforms resulting from simple superimposition of a plurality of sinusoidal waves having CSM-specified amplitudes and frequencies are obtained as outputs of the combiner 33.

The synthetic waveforms are controlled so that their total power is proportional to power $V_0$ supplied from the autocorrelation coefficient calculator 12 in the variable gain amplifier 34, and then applied to the combiner 37.

Further, the frequency of the variable frequency oscillator 35 is specified by the pitch frequency information supplied from the analyzer 16. The V/UV signal from the analyzer 16 controls the V/UV switch 36 so that the output of the oscillator 35 is passed to the combiner 37 for the voiced speech and the output is rejected to pass the switch 36 for the unvoiced speech.

From the combiner 37 is output, as an analog signal, the combined waveform resulting from combination of power controlled CSM sinusoidal waves together with pitch information (in the form of a sinusoidal wave), and transmitted along a transmission channel. The analog signal can be converted directly or without any processing into sounds which cannot be heard as speech, and therefore can provide privacy.

On the other hand, at the receiver part R shown in FIG. 14B, the thus-transmitted signals are received and analyzed by the spectrum analyzer 38. The spectrum analyzer 38 develops the amplitude $m_i \cdot v_0$ and frequency $\omega_i$ respresentative of the respective sinusoidal waves, respectively, by spectrum analysis. The power extractor 39 detects max $\{m_i \cdot v_0\}$, normalizes each amplitude $m_i \cdot v_0$ by max $\{m_i \cdot v_0\}$ and supplies the normalized amplitude to the parameter inversion converter 40 as $m_1'$, . . . , $m_n'$. Besides, in the spectrum analyzer 38, the frequency information $\omega_i$, the pitch frequency information and the V/UV information are extracted, and they are applied to the parameter inversion converter 40. It is noted here the pitch frequency information is easily obtained since the pitch frequency is generally rather smaller than those of the CSM frequencies.

The parameter inverse converter 40, which performs inverse conversion to the conversion function of the parameter converter 30 of the transmitter part, is assumed for ease of understanding to output the input signal.

Thus, the output of the spectrum analyzer 38, CSM frequencies $\omega_i$ ($\omega_1$ through $\omega_n$) of n waves are applied to the n variable frequency oscillators with phase resetting function 41(1) through 41(n) where the frequencies of the output are set to $\omega_1$ through $\omega_n$.

CSM amplitudes $m_1'$ through $m_n'$ are applied to the gain control terminals of n variable gain amplifiers 42(1) through 42(n), thereby the oscillation powers of the frequencies are controlled to specified values. The thus-obtained n outputs are subjected to combination (addition) in the combiner 43 and then input to the succeeding multiplier 44. In addition, the pitch frequency data and V/UV information extracted by the spectrum analyzer 38 are applied to the V/UV switch 46 through the parameter inverse converter 40.

On the other hand, as the embodiment of FIG. 1, the random codes from the random code generator 49 are input to the period calculator 48, there redistributed so that their distribution width and lower limit are brought to specified values and then output as a data sequence for determining the phase reset time interval for unvoiced sound, which is applied to the V/UV switch 46.

When the V/UV information from the spectrum analyzer 38 specifies voiced speech, the switch 46 positions at the pitch frequency data side to allow the pitch frequency data to be applied to the variable length window function generator 47. On the other hand, when the V/UV information specified unvoiced speech, the switch 46 positions at the data sequence side representing the random time interval generated in the stochastic process of the output of the period calculator 48 to allow the random time interval data sequence to be applied to the window function generator 47 instead of to the digital pitch sequence.

The window function generator 47 generates window functions for phase resetting, which eliminates discontinuity appearing in the output waveform. The window function generator 47 generates also phase resetting pulses.

As mentioned above, data sequence designating intervals between phase resetting pulses are supplied one after another through the switch 46 to the window function generator 47 which generates one after another impulses having time intervals designated by the data sequence. The impulses are applied to the phase reset terminals of the variable frequency oscillators with phase resetting function, 41(1) through 41(n).

Now, the window function generator 47 generates a variable length window function W(t) in synchronism with the generation of the aforesaid phase resetting pulse.

The thus-generated window function is applied to multiplier 44 which outputs the products of n sinusoidal waveforms having been synthesized in the combiner 43, to be phase-reset every phase resetting pulse, and the above-mentioned window functions W(t) generated in synchronism with every phase resetting pulse. The waveforms of the outputs are converted continuously to "0", as the result of multiplication of the window function W(t) directly before each sinusoidal wave is phase reset. Besides, at the time point of phase resetting, each sinusoidal wave rises from "0". This ensures continuity of the waveform without discontinuity which otherwise may appear in phase reset the waveform due to the multiplication.

The amplifier 45 multiplies the output of the multiplier 44 by the power $V_0$ information of each frame, which is separated by the power extractor 39, and generates a synthesized speech.

The above description has been made under the assumption that the parameter converter 30 at the transmitter part T and the parameter inverse converter 40 at the receiver part R output the input data as it is without undergoing any conversion. It is matter of course for this system to secure telephone privacy, as mentioned above. In other words, it is possible to construct a privacy telephone system provided with neither parameter converter 30 at the transmitter part T nor parameter inverse converter 40 at the receiver part R.

For achieving higher privacy, it is preferred that parameter conversion and parameter inverse conversion are performed in the parameter converter 30 and in the parameter inverse converter 40, respectively. Conversion (first conversion) of the parameters can be performed, for example, with the relation:

$$\begin{cases} \omega_i' = \omega_i + \theta_i \\ m_1' = m_i \times b_i \end{cases}$$

where $\theta_i$ and $b_i$ are constants, respectively.

An alternative preferred example is as follows. Under the assumption that sets of $\omega_i$ and $m_i$ (i=1, 2, . . . , n) are a vector ($\omega_i$, $m_i$), frequency setting of the variable frequency oscillators 31(l) through 31(n) and gain setting of variable gain amplifiers 32(l) through 32(n) are performed using vector $\omega_i'$, $m_i'$) obtained by multiplication of the vector ($\omega_i$, $m_i$) by predetermining constant matrix. Then, parameter inverse conversion can be made using the inverse matrix to restore the original vector sets ($\omega_i$, $m_i$) from the extracted ($\omega_i'$, $m_i'$).

In addition, it may utilize an arbitrary combination from the prepared combinations of parameter conversion and the corresponding parameter inverse conversion according to the data specified by the user. It can be designed so that the parameter conversion and the corresponding parameter inverse conversion vary with the lapse of time, whereby privacy can be enhanced.

Further the second conversion in which the distribution range of frequency data is converted at a given rate can be performed using the simple relation as $$\omega_i' = b_i \cdot \omega_i + \theta \quad (i=1, 2, \ldots, N)$$

where "b" and $\omega_i$ are constants. Taking $0<b<1$, the band compression transmission of speech is attained. Conversion at the receiver part can be carried out using $$\omega_i = (\omega_i - \theta)/b \quad (i=1, 2, \ldots, N)$$

Figure 15A:
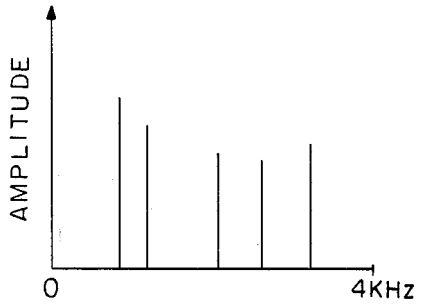
FIGS. 15A through 15D, are illustrations of the first parameter conversion in the embodiment of FIG. 14.
Figure 15B:
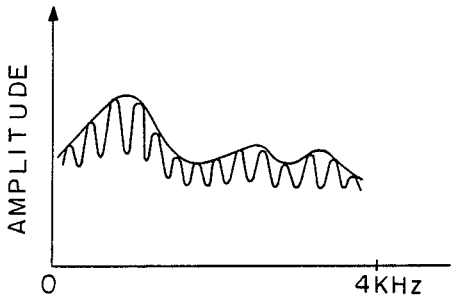
Figure 15C:
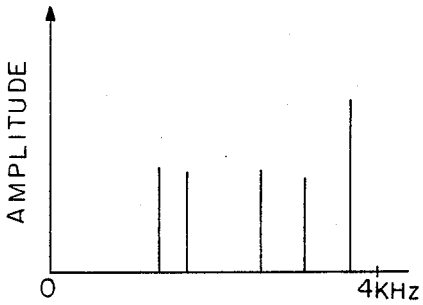
Figure 15D:
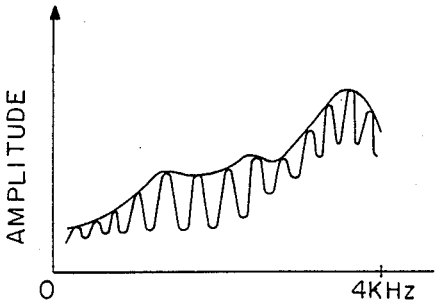
Figure 16A:
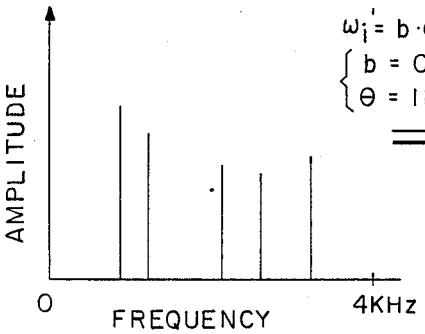
FIGS. 16A and 16B are illustrations of the second parameter conversion in the embodiment shown in FIG. 14.
Figure 16B:
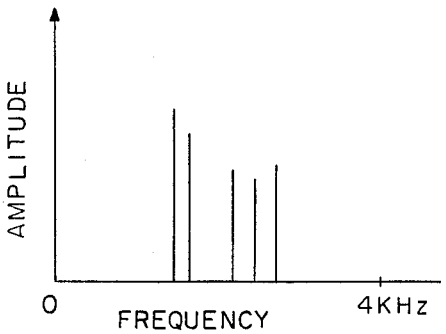

FIGS. 15A through 15D illustrate the first conversion: FIG. 15A shows the CSM spectrum distribiton and FIG. 15B reproduced power obtained from CSM data appearing in FIG. 15A. FIG. 15C shows spectrum strengths obtained by the first conversion using $\theta_i=0.5$ KHz, $b_1=0.6$, $b_3=1.0$, $b_4=1.2$ and $b_5=1.5$. The characteristic of reproduced power based on the converted CSM data shown in FIG. 15C is given in FIG. 15D. As apparent from the drawings, the first conversion takes effect to fully scramble CSM information with consequent improvement in privacy. FIGS. 16A and 16B illustrating the second conversion makes it apparent that the CSM spectrum strength distribution before conversion, shown in FIG. 16A, changes into that of FIG. 16B by the second conversion assuming $b=0.5$, and $\theta=1$ KHz, with consequent improvement in privacy and effect of band compression.

According to the invention, the transmission of pitch frequency information can be omitted as follows:

Through the utilization of the characteristic of sound that it has higher pitch frequency with increasing sound energy and vice versa, a table of the dependence of sound energy on pitch frequency is experimentally constructed, and there is provided at the receiver part R means for generating alternative pitch frequencies to be used on the basis of overall speech power information transmitted from transmitter part T in accordance with the table.

Figure 17:
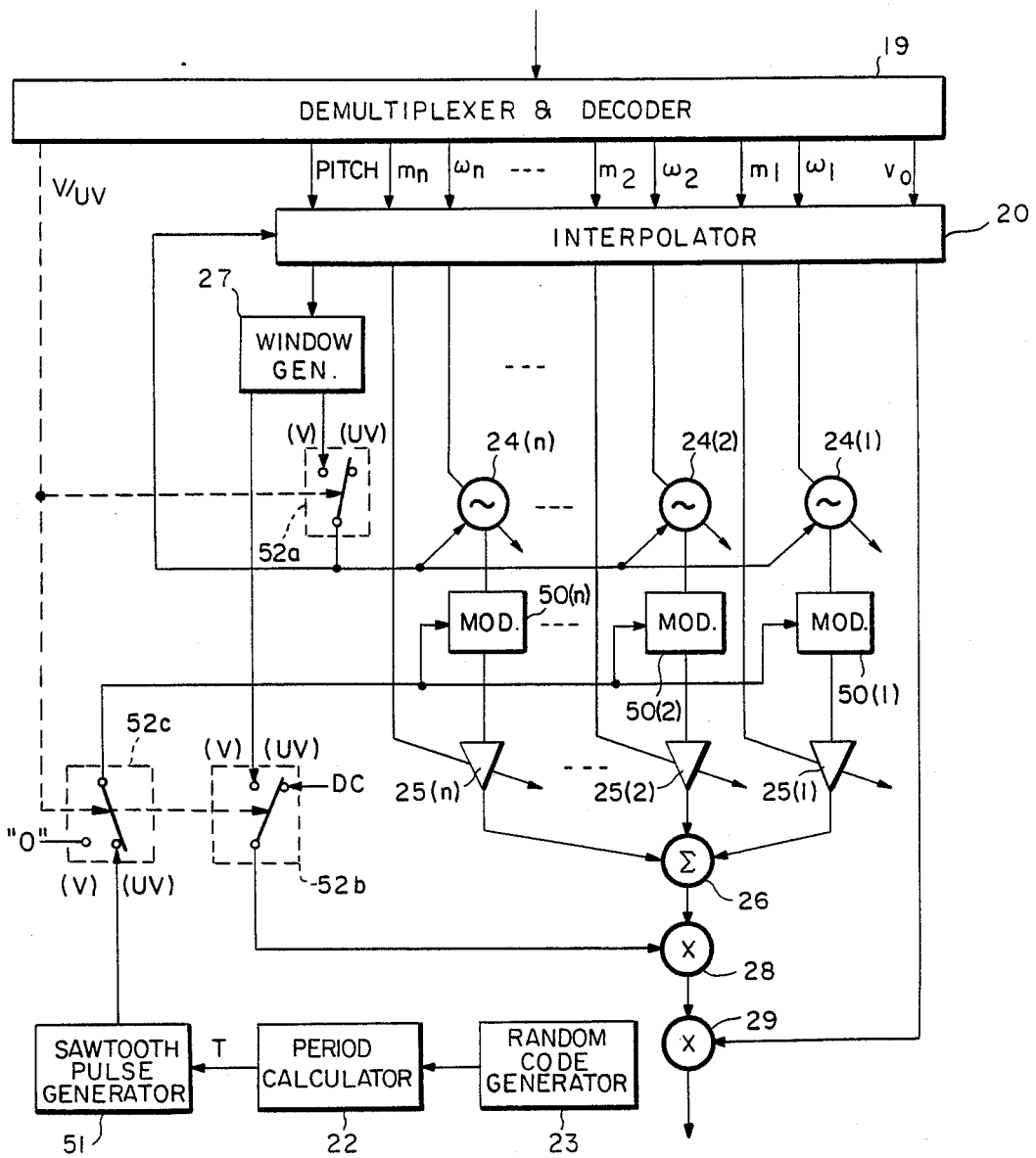
FIGS. 17 and 18 are a block diagram of another embodiment in accordance with the invention and the output waveform from the sawtooth pulse generator 51 therein, respectively.
Figure 18:
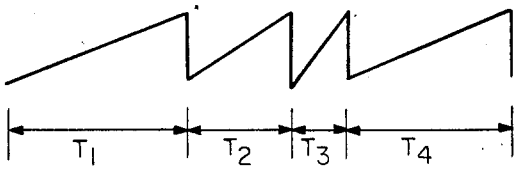

A further preferred embodiment of speech processor according to the invention comprising generating unvoiced speech on the basis of FM modulation instead of phase intialization by the use of random code data is shown in FIG. 17 in which corresponding blocks are designated by the same reference numerals as in FIG. 1. This embodiment is provided, additionally to the structure of FIG. 1, with a series of FM modulators 50(1) through 50(n), a sawtooth pulse generator 51 and switches 52*a* to 52*c*. Period data $T_1$, $T_2$, $T_3$ and $T_4$ from the frequency calculator 22 are input to the sawtooth pulse generator 51 to generate sawtooth waves having the periods $T_1$, $T_2$, $T_3$, $T_4$ (FIG. 18). The switches 52*a* through 52*c* are connected to V terminals when V (voiced speech) signal is output from the multiplexer/decoder unit 19, and to UV terminals when UV (unvoiced speech) signal is output. The FM modulator 50(1) through 50(n) perform, when the UV signal s output, FM modulation of the outputs of the oscillators 24(l) through 24(n) with sawtooth waves as modulation signals in conformity with sawtooth pulses supplied from the sawtooth pulse generator 51 through UV terminal of the switch 52*c* and, when the V signals is output, FM modulation is interrupted. Further, the resetting signal from the window function generator 27 is applied to the V terminal of the switch 52*a* and the UV terminal becomes open. In this way, voiced speech is generated when the v signal is output, and unvoiced speech is generated through FM modulation when the UV signal is output. When unvoiced speech is generated, oscillators 24(1) through 24(n) are not subjected to phase resetting by the operation of the switch 52*b*, and a constant DC signal is applied to the multiplier 28, consequently without shaping of the waveform on the basis of the window function. The interpolator 20 performs interpolation in synchronism with reset signals when the voiced signal is output, and performs every fixed period as of 5 msec when the unvoiced signal is output.

As described above, in this embodiment, sinusoidal signals are frequency-spread by means of FM modulation. Frequency spread by FM modulation is known, and hence the detail is omitted. Besides, the optimum FM modulation index may be determined experimentally from the auditory point of view. Herein it is clear that as modulation signals of FM modulation, an arbitrary waveform signal other than sawtooth wave such as $COS^2$ waveform signal can be used.

What is claimed is:

1. A speech signal processor comprising:

an extractor responsive to a speech signal supplied thereto for extracting amplitudes and frequencies of a set of sinusoidal wave signals representative of said speech signal;

a sinusoidal wave generator connected to receive said extracted amplitudes and frequencies for generating a set of sinusoidal wave signals having said extracted amplitudes and frequencies;

combining means connected to said sinusoidal wave generator for combining said set of sinusoidal wave signals from said sinusoidal wave generator;

a random code generator for generating random code signals having a distribution defined by predetermined finite upper and lower values; and a phase resetter connected to said sinusoidal wave generator for phase-resetting said sinusoidal wave signals at reset time points in response to a pitch of said speech signal when said speech signal is voiced and at a period determined in accordance with said random code signal when said speech signal is unvoiced.

2. A speech signal processor according to claim 1, further comprising a window function generator for generating a window function signal defined by the start and terminal time points thereof, said time points synchronous with said phase reset time points, and a multiplier for multiplying said window function signal by an output signal of said combining means.

3. A speech signal processor according to claim 1, further comprising an interpolator for interpolating at least said amplitudes and frequencies at every said phase reset time point.

4. A speech signal processor according to claim 1, wherein said random code signal is an M sequence signal, m being an integer.

5. A speech signal processor according to claim 1, wherein the distribution range of said random code signals is 20 to 120.

6. A speech signal processor according to claim 1, further comprising means for developing the pitch of said speech signal.

7. A speech signal processor comprising:

means for developing the amplitudes and frequencies of a set of sinusoidal signals representative of a speech signal;

a detector for detecting maximum amplitude from said developed amplitudes, a normalizer for normalizing the other amplitudes with said maximum amplitude;

a quantizer for quantizing said normalized amplitudes and frequencies;

a decoder for decoding said quantized amplitudes and frequencies;

a sinusoidal wave generator for generating a set of sinusoidal wave signals having said decoded amplitude and frequencies;

combining means for combining said set of sinusoidal wave signals from said sinusoidal wave generator;

a random code generator for generating random code signals having a distribution defined by predetermined finite upper and lower values; and a phase resetter for phase-resetting said sinusoidal wave signals in response to said pitch corresponding to said frequency of said speech signal when said speech signal is voiced and at a period determined in accordance with random code signals when said speech signal is unvoiced.

8. A speech signal processor according to claim 7, further comprising a quantizer for multiplying the power of said speech signal by said maximum amplitudes and then quantizing the product.

9. A speech signal processing system according to claim 7, wherein said quantizer is allocated the number of bits predetermined in accordance with said frequency.

10. A speech signal processor according to claim 7, further comprising a decoder for decoding said quantized amplitudes and frequencies; a sinusoidal wave generator for generating a set of sinusoidal wave signals having said decoded amplitude and frequencies; combining means for combining said set of sinusoidal wave signals from said sinusoidal wave generator; a random code generator for generating random code signals having a distribution defined by predetermined finite upper and lower values; and a phase resetter for phase-resetting said sinusoidal wave signals in response to said pitch corresponding to said frequency of said speech signal when said speech signal is voiced and at a period determined in accordance with random code signals when said speech signal is unvoiced.

11. A speech signal processor comprising:

at a transmitter part, a first parameter extractor from a speech signal amplitudes and frequencies of a set of sinusoidal wave components representative of said speech signal;

a first sinusoidal wave generator for outputting a set of sinusoidal wave signals having said extracted amplitudes and frequencies;

a first combining means for combining said set of sinusoidal wave signals from said first sinusoidal wave generator;

at a receiver part, a second parameter extractor for extracting amplitudes and frequencies of said set of sinusoidal wave components;

a second sinusoidal wave generator for generating a set of sinusoidal wave signals having said extracted amplitudes and frequencies from said second parameter extractor;

a second combining means for combining said set of sinusoidal wave signals;

a random code generator for generating random code signals;

a phase resetter for phase-resetting at reset time points said sinusoidal wave signals from said second sinusoidal wave generator in response to a pitch of said speech signal when said speech signal is voiced and at a period determined in accordance with random code signals when said speech signal is unvoiced.

12. A privacy telephone system according to claim 11, wherein said random code signals have a distribution defined by predetermined lower and upper limits values.

13. A privacy telephone system according to claim 11, further comprising, a window function generator for generating a window function signal defined by the start and terminal time points thereof, said time points synchronous with said phase reset time points, and a multiplier for multiplying said window function signal by the output of said second combining means.

14. A privacy telephone system according to claim 11, further comprising, an interpolator for interpolating at least one of said amplitude and frequencies every said phase reset time point.

15. A privacy telephone system according to claim 11, further comprising, at the transmitter part, a converter for performing a first predetermined conversion to at least one of the amplitudes and frequencies extracted by said first parameter extractor; means for outputting a set of sinusoidal signals in accordance with the converted amplitudes and frequencies to be applied to said first combining means; and at the receiver part, an inverse converter for performing an to inverse conversion in relation to said first conversion, and for outputting the resulting amplitudes and frequencies to be applied to said second sinusoidal wave generator.

16. A privacy telephone system according to claim 15, wherein said converter includes at least means for shifting said frequencies by a predetermined frequency value.

17. A privacy telephone system according to claim 15, wherein said converter includes at least means for increasing or reducing said amplitudes at a predetermined rate.

18. A privacy telephone system according to claim 15, wherein the conversion by said converter is performed using the following relation:

$$\omega_i = \omega_i + \theta_i$$
$$m_i' = m_i \cdot a_i$$

where $m_i$ and $m_i'$ are amplitudes before and after conversion; $\omega_i$ and $\omega_i'$ frequencies before and after conversion; and $\theta_i$ and $a_i$ are constants.

19. A privacy telephone system according to claim 15, wherein the conversion by said converter is performed using the following relation:

$$\omega_i' = a_i \cdot \omega_i + \theta_i$$

where $\omega_i$ and $\omega_i'$ are frequencies before and after conversion, and $a_i$ is a constant $(0 < a_i < 1)$ and $\theta_i$ is constant.

20. A privary telephone set according to claim 15, wherein said converter performs the function thereof in accordance with one arbitrarily selected from at least two different conversion modes previously provided, and said inverse converter performs the function thereof in accordance with one arbitrarily selected from at least two different inverse conversion modes previously provided.

21. A privacy telephone set according to claim 15, wherein said converter performs the function thereof in accordance with at least two different conversion modes previously provided in a previously given order with a lapse of time therebetween, and said inverse converter performs the function thereof in accordance with at least two different inverse conversion modes previously provided in a previously given order with a lapse of time therebetween.

22. A speech signal processor comprising:

an extractor responsive to a speech signal supplied thereto for extracting amplitudes and frequencies of a set of sinusoidal wave signals representative of said speech signal;

a sinusoidal wave generator connected to receive said extracted amplitudes and frequencies for generating a set of sinusoidal wave signals having said extracted amplitudes and frequencies;

combining means connected to said sinusoidal wave generator for combining said set of sinusoidal wave signals from said sinusoidal wave generator;

a random code generator for generating a random code signal having a distribution defined by predetermined finite upper and lower values;

a sawtooth signal generator for generating sawtooth signals whose periods are determined by said random code signals;

a phase resetter connected to said sinusoidal wave generator for phase-resetting said sinusoidal wave signals at reset time points in response to a pitch of said speech signal when said speech signal is voiced; and a frequency modulator for frequency-modulating each of said sinusoidal wave signals in accordance with said sawtooth signal when said speech is unvoiced.

* * * * *